US010602254B2

(12) United States Patent
Saha et al.

(10) Patent No.: US 10,602,254 B2
(45) Date of Patent: Mar. 24, 2020

(54) PACKAGING OF LUMINAIRE MOUNTED MICROPHONES

(71) Applicant: Current Lighting Solutions, LLC, East Cleveland, OH (US)

(72) Inventors: Koushik Babi Saha, Strongsville, OH (US); Thomas Clynne, East Cleveland, OH (US); Jonathan Robert Meyer, Shaker Heights, OH (US); Rick Dean Dureiko, Willoughby, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/275,190

(22) Filed: Sep. 23, 2016

(65) Prior Publication Data

US 2017/0359643 A1 Dec. 14, 2017

Related U.S. Application Data

(60) Provisional application No. 62/349,485, filed on Jun. 13, 2016.

(51) Int. Cl.

| | |
|---|---|
| ***H04R 1/02*** | (2006.01) |
| ***H04R 1/08*** | (2006.01) |
| ***F21V 31/00*** | (2006.01) |
| ***F21V 33/00*** | (2006.01) |
| *F21Y 115/10* | (2016.01) |
| *F21W 131/10* | (2006.01) |
| *F21V 23/04* | (2006.01) |

(52) U.S. Cl.
CPC ..... *H04R 1/086* (2013.01); *F21V 31/005* (2013.01); *F21V 33/0052* (2013.01); *H04R 1/028* (2013.01); *F21V 23/0442* (2013.01); *F21W 2131/10* (2013.01); *F21Y 2115/10* (2016.08); *H04R 2410/07* (2013.01)

(58) Field of Classification Search
CPC .... H04R 2201/021; H04R 1/028; H04R 1/44; H04R 1/086; H04R 2201/029
See application file for complete search history.

(56) References Cited

U.S. PATENT DOCUMENTS 2,967,957 A * 1/1961 Massa ..... B06B 1/0651 310/312
3,548,121 A * 12/1970 Wolf ..... H04R 1/083 381/359
4,887,693 A * 12/1989 Plice ..... H04R 1/086 181/242

(Continued)

FOREIGN PATENT DOCUMENTS

EP 0 769 234 A2 4/1997

*Primary Examiner* — Fan S Tsang
*Assistant Examiner* — Ryan Robinson
(74) *Attorney, Agent, or Firm* — Buckley, Maschoff & Talwalkar LLC

(57) ABSTRACT

The specification and drawings present packaging for integrating a microphone into an outdoor luminaire that provides high sensitivity and dynamic range together with being waterproof, resistant to impact and wind noise, environmentally resistant and unobtrusive to passers-by. Various embodiments describe packaging of outdoor luminaire mounted microphones to achieve waterproof and minimized unwanted noise performance, and other desirable features.

19 Claims, 5 Drawing Sheets

(56) References Cited

U.S. PATENT DOCUMENTS

| | | | | |
|---|---|---|---|---|
| 5,210,793 | A | 5/1993 | Carlson et al. | |
| 5,828,012 | A | 10/1998 | Repolleet et al. | |
| 6,512,834 | B1 | 1/2003 | Banter et al. | |
| 8,729,446 | B2 | 5/2014 | Verfuerth | |
| 9,172,917 | B1 | 10/2015 | Fu et al. | |
| 9,374,643 | B2 * | 6/2016 | Szczech | H04R 17/025 |
| 9,654,678 | B1 * | 5/2017 | Fu | H04N 7/18 |
| 2003/0210340 | A1 * | 11/2003 | Frederick Romanowich | G08B 13/19632 348/272 |
| 2011/0188247 | A1 * | 8/2011 | Huang | B01D 39/1692 362/249.02 |
| 2012/0086560 | A1 | 4/2012 | Ilyes et al. | |
| 2014/0083296 | A1 * | 3/2014 | Sanders | G06F 1/1656 96/11 |
| 2014/0211974 | A1 | 7/2014 | Pielsticker | |
| 2014/0294217 | A1 * | 10/2014 | Yamaguchi | H04M 1/035 381/334 |
| 2015/0289042 | A1 * | 10/2015 | Yamaguchi | H04R 1/086 381/87 |
| 2016/0207006 | A1 * | 7/2016 | Furuyama | H05K 5/0213 |

* cited by examiner

PACKAGING OF LUMINAIRE MOUNTED MICROPHONES

TECHNICAL FIELD

The invention generally relates to luminaires. More particularly but not exclusively, this invention relates to packaging of an outdoor luminaire mounted microphone for achieving waterproof and minimized unwanted noise performance.

BACKGROUND OF THE INVENTION

Outdoor luminaires have begun to be pressed into service as power and mounting platforms for a variety of electronic sensor and data processing systems. The sensors used in these systems can be one or more from a wide variety including, but not limited to, cameras, microphones, environmental gas sensors, accelerometers, gyroscopes, antennas, and many others.

Due to the nature of outdoor placement, exposure to a variety of weather conditions must be considered when contemplating the construction of such a system. A variety of traditional sealing and weatherproofing methods exist for the creation of a housing that can contain the electronics portion of the system, and standard methods exist for means to protect optical elements, such as protective windows and performance enhancement coatings for use with cameras and lenses. A special case exists when considering the means to package a microphone for use on such an outdoor luminaire platform, as further described herein.

SUMMARY OF THE INVENTION

According to a first aspect of the invention, an outdoor luminaire, comprising: an exterior housing comprising a wall being waterproof and comprising one or more holes, where each of the one or more holes is covered on an interior surface of the wall with a membrane, e.g., comprising polytetrafluoroethylene (ePTFE), using a waterproof seal, wherein the membrane is waterproof and impervious to ultraviolet radiation but substantially transparent to sound waves; one or more microphones, each located in a vicinity of a corresponding hole of the one or more holes and configured to receive a corresponding sound wave signal through the corresponding hole; and a foam material (e.g., low density foam material) surrounding the each of the one or more microphones (i.e., mounted inside of the foam material) to mechanically de-couple the each microphone from the exterior housing to protect the each microphone from detecting unwanted outside noises (which may include one or more of: an impact noise of falling rain drops, sleet or hail), wherein an exterior surface of the wall including each hole and all parts of corresponding one or more areas surrounding each of the one or more microphones are unobtrusive into an exterior air column surrounding the exterior surface of the wall in order to reduce creation of a wind noise which is detectable by at least one of the one or more microphones.

According further to the first aspect of the invention, the each of the one or more microphones may be separated from the membrane by a predefined distance, which can be provided by a spacer also made from a foam material.

According to a second aspect of the invention, a sensor module attachable to and detachable from an outdoor luminaire, the sensor module comprising: an exterior housing comprising a wall being waterproof and comprising one or more holes, where each of the one or more holes is covered on an interior surface of the wall with a membrane, e.g., comprising polytetrafluoroethylene (ePTFE), using a waterproof seal, wherein the membrane is waterproof and impervious to ultraviolet radiation but substantially transparent to sound waves; one or more microphones, each located in a vicinity of a corresponding hole of the one or more holes and configured to receive a corresponding sound wave signal through the corresponding hole; and a foam material (e.g., low density foam material) surrounding the each of the one or more microphones (i.e., mounted inside of the foam material) to mechanically de-couple the each microphone from the exterior housing to protect the each microphone from detecting unwanted outside noises (which may include one or more of: an impact noise of falling rain drops, sleet or hail), wherein an exterior surface of the wall including each hole and all parts of corresponding one or more areas surrounding each of the one or more microphones are unobtrusive into an exterior air column surrounding the exterior surface of the wall in order to reduce creation of a wind noise which is detectable by at least one of the one or more microphones.

According further to the second aspect of the invention, the each of the one or more microphones may be separated from the membrane by a predefined distance, which can be provided by a spacer also made from a foam material.

BRIEF DESCRIPTION OF THE DRAWINGS

These and other features and aspects of the present disclosure will become better understood when the following detailed description is read, with reference to the accompanying drawings, in which like characters represent like parts throughout the drawings, wherein:

(FIG. 1A is a 3-D view, and FIG. 1B is a 3-D cross-sectional view), according to an embodiment of the invention;

DETAILED DESCRIPTION

Figure 1A:
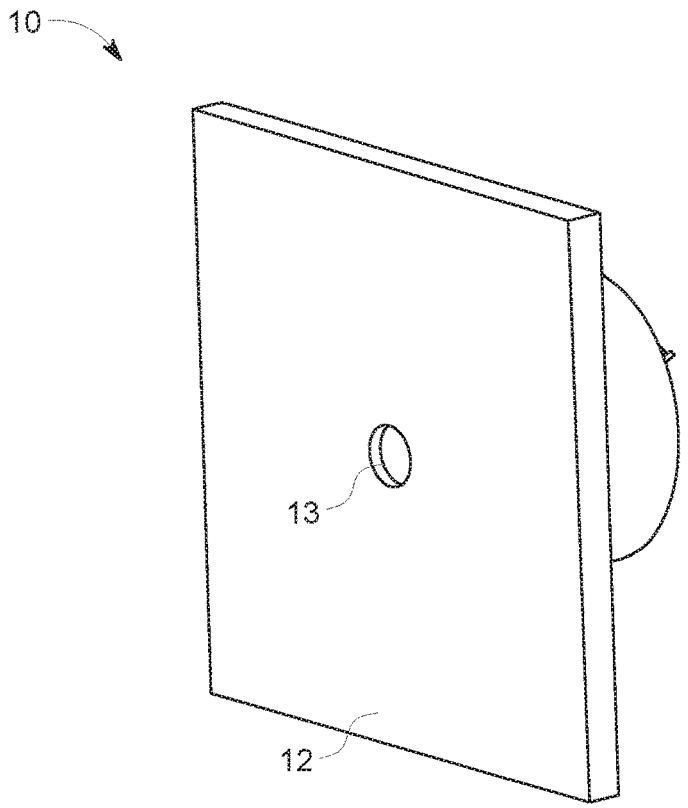
FIGS. 1A-1B are three-dimensional (3-D) exemplary views of a microphone packaging sample

New packaging is presented for integrating a microphone into an outdoor luminaire that provides high sensitivity and dynamic range together with being waterproof, resistant to impact and wind noise, environmentally resistant and unobtrusive to passers-by. Various embodiments describe packaging of outdoor luminaire mounted microphones to achieve waterproof and minimized unwanted noise performance, and other desirable features.

For use with an outdoor luminaire, and by virtue of its high position relative to the street, as well as due to outdoor environmental requirements, a microphone needs to be able to have the following characteristics (referred to as a "List of Requirements" in this document):

- waterproof—the microphone must be waterproof so as to avoid electrical shorting and/or signal attenuation from changing the mass of the microphone active structure via the collection of water;
- dynamic range and sensitivity—the microphone, by virtue of its requirement to pick up a wide range of sounds, must be mounted and protected in a way so that the incoming sounds are not attenuated by the components and materials chosen to protect it; further, the mounting system should not alter the frequency/amplitude makeup of the acoustic signals being detected;
- impact noise resistance—an outdoor luminaire mounted microphone has to be resistant to conducted impact noises such as that encountered by rain, sleet and hail which will obscure the sounds of interest and potentially cause false alarms to be reported to the signal analysis software;
- wind noise resistance—the microphone must be mounted in a manner so that it does not impede the flow of wind around the housing, lest it generate its own noise component from pressure buffeting, thereby masking the incoming sounds which it is intended to detect;
- unobtrusiveness—it is advantageous to make the microphone unobtrusive to passers-by, so that they are less likely to observe that their sounds are being detected; and
- environmental resistance—any materials used and exposed to rain and direct sunlight be able to withstand the degrading effects of weathering and UV (ultraviolet) sunlight exposure.

The various embodiment of the invention described herein provide a solution for mounting a microphone into an outdoor luminaire and simultaneously meeting all of the desired characteristics above, namely being waterproof, having good dynamic range and sensitivity, having high impact noise resistance, wind noise resistance, unobtrusiveness and environmental resistance.

In different embodiments, a material known to manufacturers of outdoor luminaires as GORE-TEX vents, can be used. GORE-TEX vents have a desirable property such that gases can pass easily through their extremely small pore expanded polytetrafluoroethylene (ePTFE) structure, while not allowing liquids to pass through due to their high relative surface tension. Also the ePTFE material is a UV resistant material. Traditionally, GORE-TEX vents have been used to allow the luminaire to "breathe" between the interior of the housing and outside environment. This gas permeability, together with the non-rigid structure of GORE-TEX ePTFE material, makes it an ideal material for shielding a microphone. Sound waves may be able to pass through the Gore-Tex vent with very little loss in acoustic energy, while liquids are prevented from doing so. The non-rigid structure of the ePTFE material typically does not reverberate and does not modally respond to in-band acoustic energy.

The expanded PTFE can be a mechanically processed form of PTFE (also known as TEFLON) that gives it a porous structure with pore sizes large enough to let gases pass through, but small enough that the surface tension of liquid water cannot pass. It is possible that other open or closed cell materials may be also used, including any type of sheet membrane comprising materials like plastic, polycarbonate, and the like that can also be described as being UV resistant in order to meet the weathering requirement.

Moreover, in order to make the microphone less susceptible to impact noises, it may be necessary to mechanically decouple the microphone from any part which can easily conduct noise from the exterior housing. The impact of falling rain drops, sleet and hail can generate significant conducted and ringing noise within the structure, and any component which is tightly mechanically coupled to it can sense this noise. By utilizing a sufficient layer of a foam material such as low density foam material between the microphone and the housing according to an embodiment of the invention, this conducted noise can be greatly reduced or eliminated altogether.

Furthermore, in order to make the microphone less susceptible to wind noise, it is desirable to have the outer housing of the structure and any portion surrounding the microphone to be as smooth as possible. The housing can be made from aluminum, but can also be made from other metals or rigid materials such as plastic.

By mounting the microphone behind a small hole in the structure, it can easily sense the acoustic pressure waves which it is intended to detect. By thinning out the material on the interior or exterior surface annularly surrounding the hole, the GORE-TEX membrane can be adhesively bonded to the interior surface and restore the outer surface to a nearly smooth construction. It can be further improved by tapering the edges of the hole so that the housing and interior mounted GORE-TEX membrane meet at a "knife edge", which can further serve to make a smooth exterior so as to avoid the creation of turbulence which can, in turn, generate noise by virtue of its rapidly changing pressure component. Traditional means for shielding against wind noise include the use of windscreens made from faux fur or low density foam, but neither of these materials would function well for long duration exposure to the elements, and would also serve to make the microphone more noticeable to passers-by.

Thus, according to one embodiment of the invention, in order to meet the List of Requirements, an outdoor luminaire can comprise: an exterior housing comprising a wall being waterproof and comprising one or more holes, where each of the one or more holes is covered on an interior surface of the wall with a membrane using a waterproof seal, wherein the membrane is waterproof and impervious to ultraviolent radiation but substantially transparent to sound waves; one or more microphones, each located in a vicinity of a corresponding hole of the one or more holes and configured to receive corresponding sound wave signal through the corresponding hole; and a foam material (such as low density foam material) surrounding the each of the one or more microphone to mechanically de-couple the each microphone from the exterior housing to protect the each microphone from detecting outside noises (which can include, e.g., one or more of: an impact noise of falling rain drops, sleet or hail), wherein an exterior surface of the wall including each hole and all parts of corresponding one or more areas surrounding each of the one or more microphones are unobtrusive into the exterior air column surrounding the surface of the wall in order to reduce the opportunity to create wind noise which may otherwise be detected by any of the one or more microphones.

According to further embodiments, each of the one or more microphones may be mounted inside of the low density foam. Also, each of the one or more microphones may be separated from the membrane (the membrane can be comprised of ePTFE) by a predefined distance for optimum detection, wherein the distance is such that the aperture of the microphone is held closely to the exterior wall, but not far enough away so that it attenuates the sound pressure detection. This is often determined empirically as a function of the various frequencies of the sounds to be preferentially detected. The predefined distance can be provided/defined (optionally) using a spacer, which can comprise a foam material (e.g., low density material). Still further according to various embodiments, the membrane can be configured to minimize reflected sound waves to avoid reverberation. Also, a presence of the one or more microphones can be provided to be non-obstructive to passers-by (see FIG. 4B). According to another embodiment, a sensor module (e.g., for surveillance) comprising the packaged microphone(s) described herein, can be attachable to and detachable from the outdoor luminaire (see FIGS. 4B and 5).

Figures presented below provide non-limiting examples for practicing various embodiments of the invention. It is noted that identical or similar parts/elements are designated using the same reference numbers in different figures.

Figure 1B:
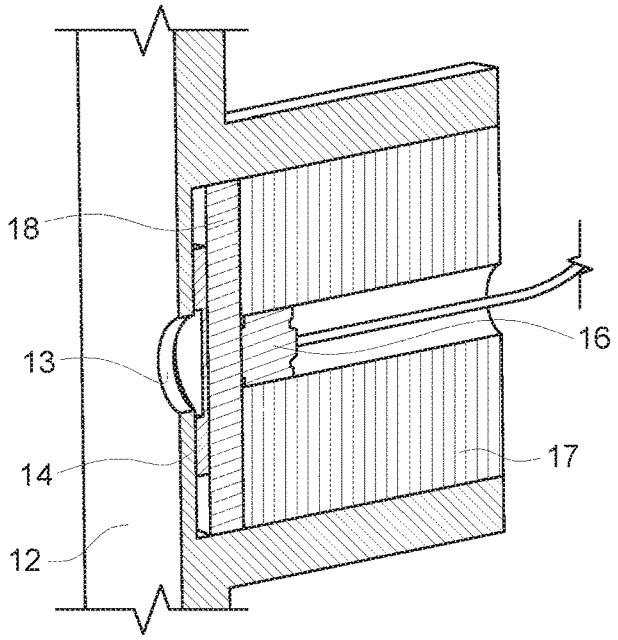

FIGS. 1A-1B are three-dimensional (3-D) exemplary views of a microphone packaging sample 10 (FIG. 1A is a 3-D view, and FIG. 1B is a 3D cross-sectional view), according to an embodiment of the invention. A waterproof wall 12 represents a portion of luminaire housing, and has a hole 13 for providing a desirable sound wave to a microphone 16, as shown in the cross-sectional view of FIG. 1B. The sound wave impinging on the hole 13, before being sensed/detected by the microphone 16, is going through a membrane 14 (e.g., comprising the ePTFE material) which is sealed (for providing waterproof performance) to an interior surface of the wall 12 (see FIGS. 2A-2B for further details) and through a foam spacer 18 (e.g., comprising a low density foam material). As described herein, the membrane 14 can provide the desired waterproof properties and UV protection without affecting the detected sound wave, and the foam spacer 18 (optional) can provide an optimum acoustic detection distance for the microphone 16 and can further help attenuate undesirable noise signals. It is further shown in FIG. 1B that the microphone 16 is surrounded by the low density foam 17 for further protection from outside noises, according to an embodiment of the invention.

Figure 2A:
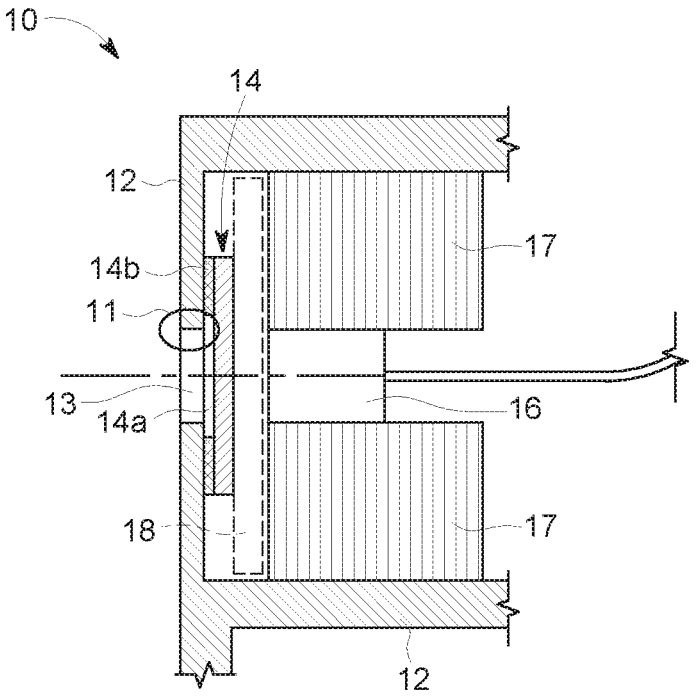
FIGS. 2A-2B are two-dimensional cross-sectional views of the microphone packaging sample (FIG. 2A) and of an ePTFE membrane (FIG. 2B) for practicing embodiments of the invention.
Figure 2B:
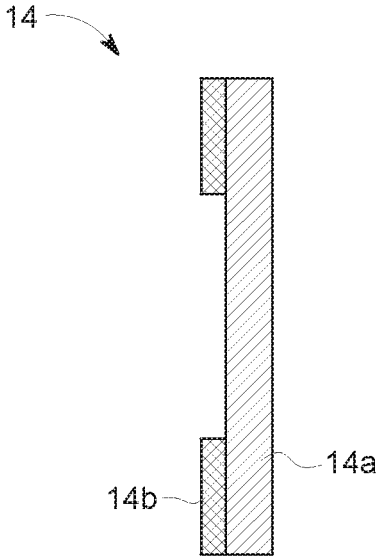

FIGS. 2A-2B are exemplary two-dimensional cross-sectional views of the microphone packaging sample 10 (FIG. 2A) and of a membrane 14 (FIG. 2B) for practicing various embodiments of the invention. The membrane 14 comprises an ePTFE membrane portion 14*a* and an adhesive portion 14*b*. The adhesive portion 14*b* is used to attach the membrane 14 to the internal surface of the wall/housing 12. Area 11 in FIG. 2A have some elements with sharp edges which may be further smoothed for reducing, e.g., wind caused noise, as demonstrated in FIG. 3.

Figure 3:
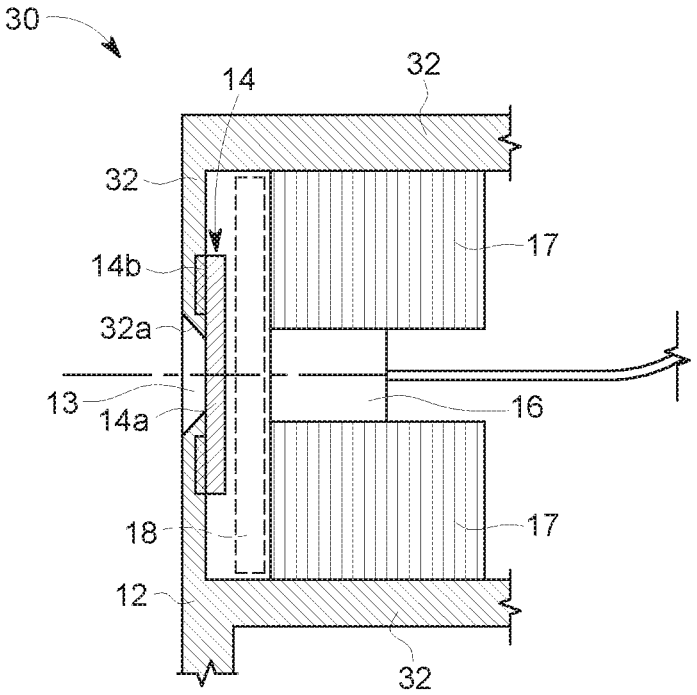
FIG. 3 is a two-dimensional cross-sectional view of the microphone packaging sample with improved design, according to an embodiment of the invention.

FIG. 3 is an exemplary two-dimensional cross-sectional view of a microphone packaging sample 30 with improved design, according to an embodiment of the invention. First, the hole 13 can be tapered to provide a circular chamfered surface 32*a*. Second, the material on the interior surface of the waterproof wall 32 can be thinned annularly around the hole 13, so that the adhesive portion 14*b* of the membrane 14 can be adhesively bonded to the thinned portion of the interior surface of the wall 32, as shown in FIG. 3. Then the tapered surface 32*a* and the outer surface of the membrane 14 meet at a "knife edge", making transition from the wall 32 to the membrane 14 smooth and continuous, as desired and shown in FIG. 3.

Figure 4A:
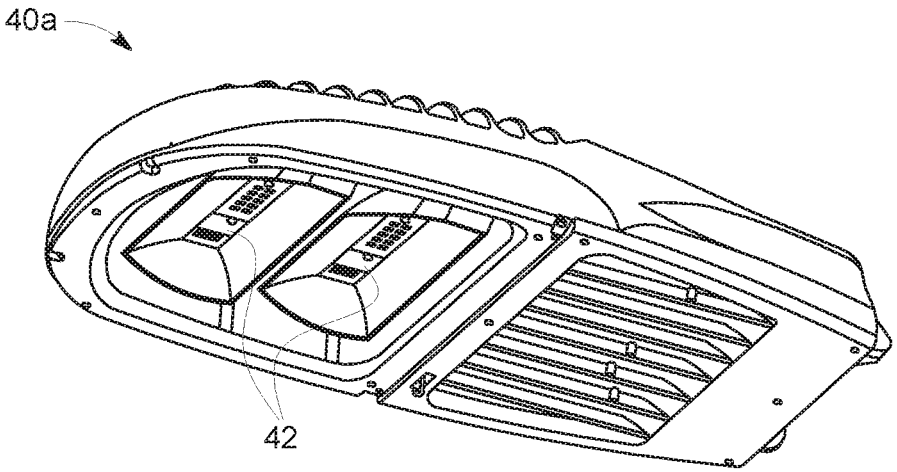
FIGS. 4A-4B are three-dimensional views of an original luminaire unit (FIG. 4A) with LED modules, and of a modified luminaire unit (FIG. 4B) which further include a sensor module (surveillance unit) which can be attachable to and detachable from the original luminaire unit of FIG. 4A, according to an embodiment of the invention.
Figure 4B:
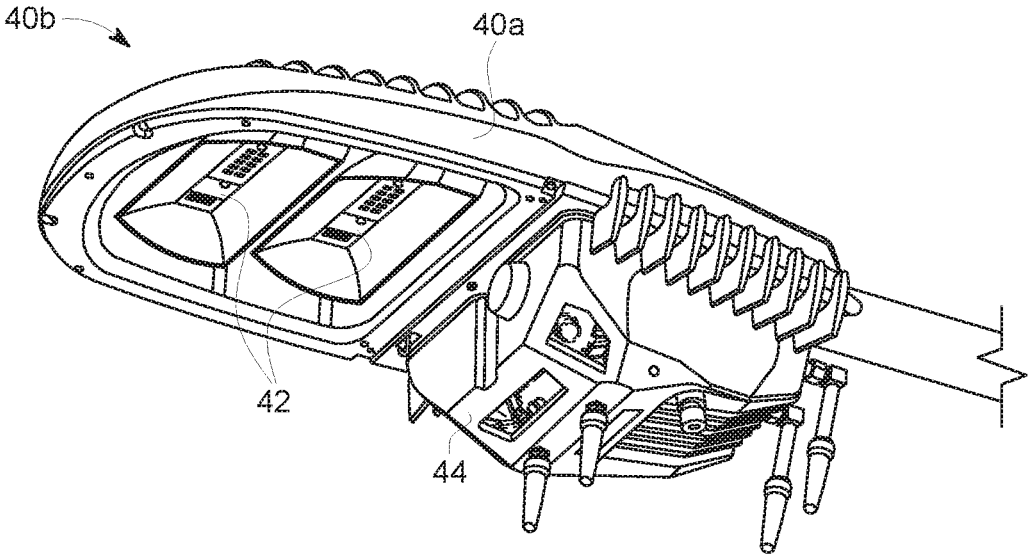

FIGS. 4A-4B are non-limiting exemplary three-dimensional views of an original luminaire unit 40*a* (FIG. 4A) with LED modules 42, and a modified luminaire unit 40*b* (FIG. 4B) which further includes a sensor module (surveillance unit) 44 which can be attachable to and detachable from the original luminaire unit 40*a*.

Figure 5:
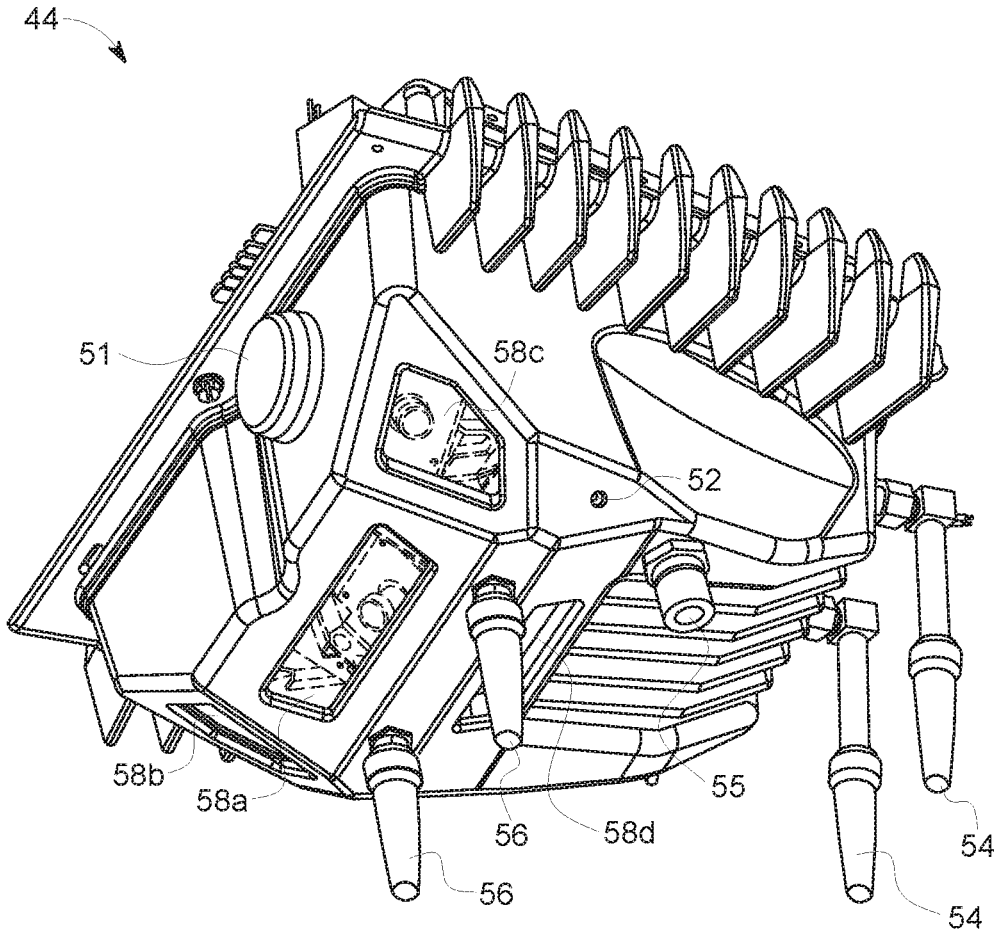
FIG. 5 is a bottom three-dimensional view of the sensor module, according to an embodiment of the invention.

FIG. 5 is a bottom three-dimensional view of the sensor module 44. It comprises multiple sensors including a microphone 52 which may be packaged according to embodiments described herein. Other sensors may also include multiple cameras 58*a*-58*d*, an environmental sensor 55, a GPS antenna 51, Wi-Fi antennas 54 and cell modem antennas 56.

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus claimed, specific terminology is employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications.

Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

What is claimed is:

1. An outdoor luminaire, comprising:

an exterior housing comprising a wall being waterproof and comprising one or more holes, wherein material on an interior surface of the wall is thinned annularly around each of the one or more holes, where each hole is covered on an interior surface of the wall with a gas permeable and non-rigid membrane that is adhesively bonded to the thinned annular portion of the interior surface of the wall forming a waterproof seal, wherein the gas permeable and non-rigid membrane is waterproof, impervious to ultraviolet radiation, and substantially transparent to sound waves;

one or more microphones, each microphone located in a vicinity of and configured to receive a sound wave signal; and a foam material surrounding each microphone to mechanically de-couple each microphone from the exterior housing and to protect each microphone from detecting unwanted outside noises.

2. The outdoor luminaire of claim 1, wherein each microphone is mounted inside of the foam material.

3. The outdoor luminaire of claim 1, wherein each microphone is separated from the gas permeable and non-rigid membrane by a predefined distance.

4. The outdoor luminaire of claim 3, wherein the predefined distance is provided using a spacer.

5. The outdoor luminaire of claim 4, wherein the spacer comprises one of the foam material and a further foam material.

6. The outdoor luminaire of claim 1, wherein the gas permeable and non-rigid membrane comprises an expanded polytetrafluoroethylene (ePTFE).

7. The outdoor luminaire of claim 1, wherein the unwanted outside noises include one or more of: an impact noise of falling rain drops, sleet or hail.

8. The outdoor luminaire of claim 1, wherein the gas permeable and non-rigid membrane is configured to minimize reflected sound waves to avoid reverberation.

9. The outdoor luminaire of claim 1, wherein an exterior surface of the wall of each hole is tapered, providing a smooth and continuous transition to an outer surface of the gas permeable and non-rigid membrane to reduce creation of the wind noise.

10. A sensor module comprising:

an exterior housing comprising a wall including one or more holes, wherein material on an interior surface of the wall is thinned annularly around each of the one or more holes, where one or more of the holes is covered on an interior surface of the wall with a substantially gas-permeable and non-rigid membrane that is adhesively bonded to the thinned annular portion of the interior surface of the wall, forming a waterproof seal, said substantially gas-permeable and non-rigid membrane being substantially waterproof, resistant to ultraviolet radiation, and substantially transparent to sound waves;

one or more microphones, each located proximate a corresponding hole of the one or more holes and configured to receive a sound wave through the corresponding hole; and a foam material at least partially surrounding each of the one or more microphones to mechanically de-couple each microphone from the exterior housing.

11. The sensor module of claim 10, wherein the sensor module is attachable to an outdoor luminaire.

12. The sensor module of claim 10, wherein the each of the one or more microphones is mounted inside of the foam material.

13. The sensor module of claim 10, wherein the foam material protects each microphone from detecting unwanted outside noises.

14. The sensor module of claim 10, wherein the each of the one or more microphones is separated from the membrane by a predefined distance provided by using a spacer.

15. The sensor module of claim 10, wherein the membrane comprises an expanded polytetrafluoroethylene (ePTFE).

16. The sensor module of claim 10, wherein an exterior surface of the wall of each of the one or more holes is tapered for providing a smooth and continuous transition to an outer surface of the membrane in order to reduce creation of the wind noise.

17. A sensor module comprising:

an exterior housing comprising a wall including one or more holes, where material on an interior surface of the wall is thinned annularly around each of the one or more holes and wherein the one or more of the holes is covered on an interior surface of the wall with a substantially gas-permeable and non-rigid membrane that is bonded to the thinned interior surface of the wall forming a waterproof seal, said substantially gas-permeable and non-rigid membrane being substantially waterproof, resistant to ultraviolet radiation, and substantially transparent to sound waves;

one or more microphones, each located proximate a corresponding hole of the one or more holes and configured to receive a sound wave through the corresponding hole; and a foam material at least partially surrounding each of the one or more microphones to mechanically de-couple each microphone from the exterior housing.

18. The sensor module of claim 17, wherein the sensor module is attachable to an outdoor luminaire.

19. The sensor module of claim 17, wherein an exterior surface of the wall of each of the one or more holes is tapered for providing a smooth and continuous transition to an outer surface of the membrane in order to reduce creation of the wind noise.

* * * * *